United States Patent [19]

Kawashita et al.

[11] Patent Number: 5,035,282

[45] Date of Patent: Jul. 30, 1991

[54] HEAT EXCHANGER MADE OF ALUMINUM AND SURFACE TREATING METHOD THEREFOR

[75] Inventors: Hiroichi Kawashita; Yasunori Komatsu, both of Wako, Japan

[73] Assignee: Honda Giken Kogyo Kabushiki Kaisha, Tokyo, Japan

[21] Appl. No.: 418,308

[22] Filed: Oct. 6, 1989

[30] Foreign Application Priority Data

Oct. 7, 1988 [JP] Japan ..... 63-251866

[51] Int. Cl.[5] ..... F28F 19/02

[52] U.S. Cl. ..... 165/133; 165/134.1

[58] Field of Search ..... 165/133, 134.1

[56] References Cited

U.S. PATENT DOCUMENTS 4,172,164 10/1979 Meyer et al. ..... 428/72
4,726,886 2/1988 Kaneko et al. ..... 204/37.6
4,830,101 5/1989 Ohara et al. ..... 165/133

FOREIGN PATENT DOCUMENTS 62-182298 1/1986 Japan .

*Primary Examiner*—Allen J. Flanigan
*Attorney, Agent, or Firm*—Armstrong, Nikaido, Marmelstein, Kubovcik & Murray

[57] ABSTRACT

A heat exchanger made of aluminum and apt to collect water thereon, e.g., an evaporator of an automotive air conditioning system is provided with an anodized surface layer which has numerous pores therein. Fungicide is filled in the pores to eliminate an offensive smell ascribable to mold.

1 Claim, 1 Drawing Sheet

HEAT EXCHANGER MADE OF ALUMINUM AND SURFACE TREATING METHOD THEREFOR

BACKGROUND OF THE INVENTION

The present invention relates to a heat exchanger applicable, but not limited to, an evaporator of an automotive air conditioning system and, more particularly, to a heat exchanger of the type having fins and a tube one or both of which are made of aluminum or alloy thereof.

An automotive air conditioning system, for example, incorporates two independent heat exchangers in the form of a condenser and an evaporator. The condenser liquefies a high-temperature high-pressure refrigerant by cooling it, while the evaporator cools ambient air by evaporating the liquefied refrigerant. Each of such heat exchangers is constituted by a tube which allows the refrigerant to flow therethrough, and fins held in tight contact with the outer periphery of the tube for radiating the heat of the refrigerant to surrounding air. Generally, the fins and tube or at least the fins are made of aluminum or alloy thereof to provide the heat exchanger with a light-weight construction.

Since the refrigerant flowing through the evaporator lowers the surface temperature of the evaporator due to evaporation heat, moisture contained in an air stream around the evaporator is condensed and apt to deposite on the surfaces of the fins together with dust and other impurities. Water thus deposited on the fins during the operation of the air conditioning system undesirably keeps the surfaces of the evaporator wet over a long period of time even after the deactivation of the system, because the gap between nearby fins is too small to promote drying. Especially, when the air conditioning system is used very often as in summer, the evaporator suffers from temperature and humidity which are easy to glow mold every time the operation of the system is interrupted. The mold causes the dust-containing water deposited on the surfaces of the evaporator to become rotten. As a result, when the system is restarted after some interval, air cooled in contact with the evaporator and introduced into a compartment such as a vehicle cabin often entrains a putrid smell.

Mold of the above discussed nature will be eliminated if an organic high polymer containing fungicide is applied to the surfaces of the evaporator to form a protective layer, as disclosed in Japanese Patent Laid-Open Publication (Kokai) Nos. 58-102073 and 60-50397 by way of example. Another anti-mold implementation may be spraying fungicide onto the surfaces of the evaporator at an adequate time, as shown and described in Japanese Patent Laid-Open Publication No. 59-45213.

The fungicide-containing organic high polymer scheme, however, has a problem regarding the affinity and heat conductivity of the polymer coating and aluminum which forms the evaporator. Hence, the fungicide-containing high polymer needs a delicate and complicated composition, increasing the cost of an evaporator. Moreover, the efficiency attainable with such an implementation is low because it is only the fungicide exposed to the ambience on the coating surface that is effective.

The fungicide-spraying scheme, i.e., spraying fungicide at an adequate time such as at the start of operation of the system is not practicable without needing a special fungicide reservoir and a device for spraying fungicide fed thereto from the reservoir, also resulting in the increase in cost. In the case of an automotive vehicle, exclusive spaces have to be secured in an engine compartment for accommodating the reservoir, spraying device, etc. Nozzles for spraying the fungicide need to be located in front of the evaporator and, therefore, block the stream of air around the evaporator. Further, the amount of fungicide capable of depositing on the surfaces of the evaporator is too small to guarantee the anti-mold effect over a substantial period of time, and the sprayed fungicide is undesirably entrained by cooled air into the compartment.

A heat exchanger made of aluminum is generally subjected to surface treatment which relies on anodization, for the purpose of enhancing corrosion resistance. An anodized layer formed on a heat exchanger by such surface treatment has a number of pores therein. It has been customary to close the pores by sealing, as taught in Japanese Patent Laid-Open Publication No. 60-134198.

SUMMARY OF THE INVENTION

It is therefore an object of the present invention to provide a heat exchanger made of aluminum which is inexpensive and, yet, guarantees mold prevention over a long period of time.

It is another object of the present invention to provide a surface treating method which allows a great amount of fungicide to be retained on the surface of a heat exchanger which is made of aluminum.

It is a further object of the present invention to make positive and advantageous use of pores which are formed in a heat exchanger by anodization.

In order to achieve the above objects, a heat exchanger made of aluminum of the present invention has fins and a tube at least a part of which is anodized to form an anodized surface layer having numerous pores. Fungicide is filled in the pores.

The fungicide accommodated in the numerous pores of the anodized surface layer is retained surely and in a great amount by the heat exchanger. The fungicide exhibits its effect through the open ends of the pores and, therefore, over a long time.

The fungicide is filled in the pores by simple treatment, i.e., by immersing the anodized heat exchanger in a solution prepared by solving fungicide in a solvent or in liquid fungicide.

In a preferred embodiment of the present invention, the heat exchanger retaining fungicide in its pores is subjected to a sealing step in order to restrict the open ends of the pores. With this additional treatment, it is possible to substantially eliminate the outflow of the fungicide and to control the effect of the fungicide, promoting efficient prevention of mold.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
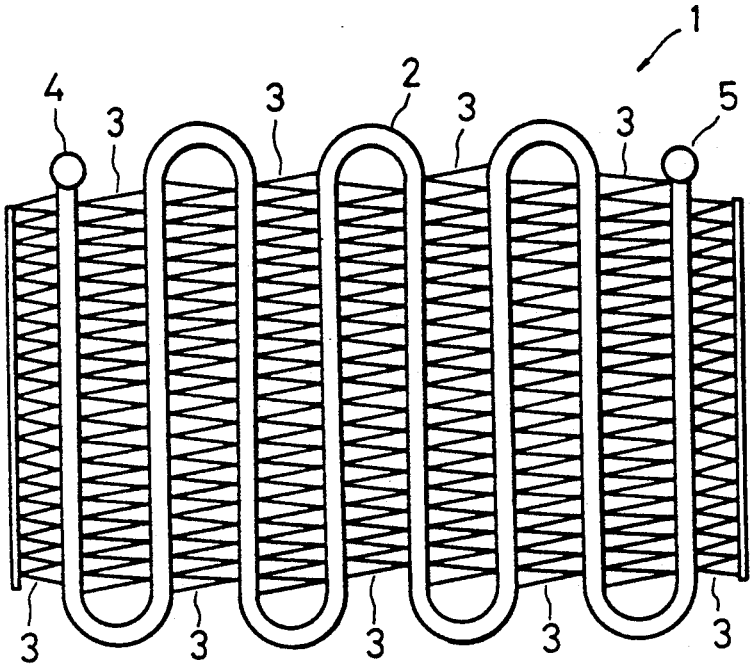
FIG. 1 is a front view schematically showing a heat exchanger made of aluminum embodying the present invention.

Referring to FIG. 1 of the drawings, an evaporator representative of a heat exchanger embodying the present invention is shown which is made of aluminum. The evaporator, generally 1, has a flat tube 2 which is bent in a zig-zag configuration. Corrugated fins 3 are connected to the outer periphery of the tube 2 in tight contact with the latter. A refrigerant flows into the tube 2 through an inlet 4 and out of the tube 2 through an outlet 5.

Figure 2:
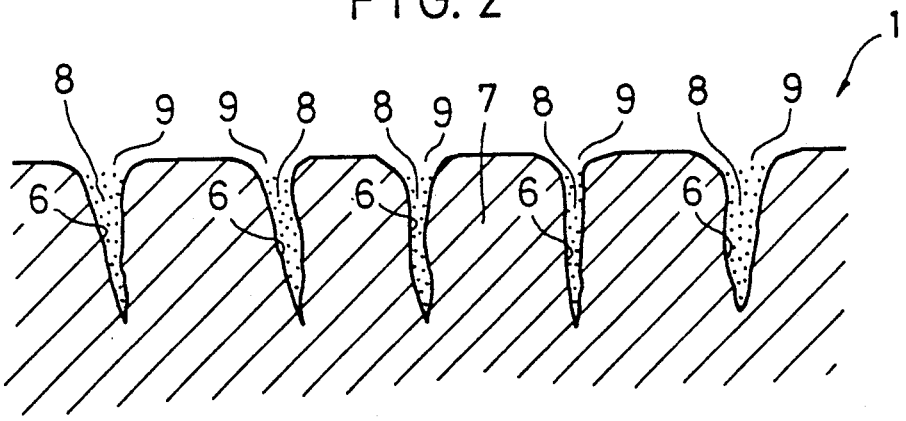
FIG. 2 is a fragmentary section showing an anodized surface layer of the illustrative embodiment in an enlarged scale.

In the illustrative embodiment, both the tube 2 and the fins 3 are made of aluminum or aluminum alloy. The surfaces of the tube 2 and fins 3 are anodized. As shown in FIG. 2, anodization provides the tube 2 and fins 3 with an anodized surface layer 7 which has a number of pores 6 therein. The pores 6 are filled with fungicide 8 which may be comprised of benzimidazole compounds, nitrogen-containing sulfur compounds, organic nitrogen-halogen-sulfur compounds, or organic iodine compounds by way of example.

A specific procedure for producing the evaporator 1 having the above structure is as follows. The tube 2 and fins 3 made of aluminum are connected together to form the evaporator assembly 1. After the refrigerant inlet 4 and outlet 5 of the evaporator 1 have been stopped up, the evaporator 1 is bodily immersed in a 15 percent to 20 percent solution of sulfuric acid. In this condition, a voltage of 12 volts to 16 volts is applied to the evaporator 1 to form the anodized surface layer 7 on the evaporator 1 to a thickness of 10 microns to 20 microns. The surface layer 7 has the previously mentioned pores 6 each being open at the surface of the layer 7.

The evaporator 1 anodized as stated above is rinsed and then dried. The dried evaporator 1 is immersed in fungicide 8 which is implemented as fungicide solved in water or alcohol or similar solvent or as liquid fungicide. This causes the liquid to penetrate into the pores 6 of the anodized surface layer 7 by capillarity. To allow the fungicide 8 to penetrate more easily into the pores 6, the liquid in which the evaporator 1 is immersed may be compressed or, alternatively, electric current may be applied to cause electrodeposition.

Thereupon, the evaporator 1 is removed from the liquid or fungicide 8 and then dried again to complete the evaporator 1.

In the evaporator produced by the above procedure, the fungicide 8 is retained in the surface layer 7 and is exposed to the outside through the open ends, labeled 9, of the pores 6. The fungicide 8, therefore, acts on the surface of the evaporator 1 for protecting it against mold. Since the pores 6 have a small diameter, the fungicide 8 is prevented from flowing out at a time. This, coupled with the fact that the pores 6 are deep enough to accommodate a great amount of fungicide 8, insures the anti-mold effect over a long time. In addition, air flowing past the evaporator 1 makes direct contact with the surface of the anodized surface layer 7, so that the heat conductivity of the evaporator 1 is not effected.

Figure 3:
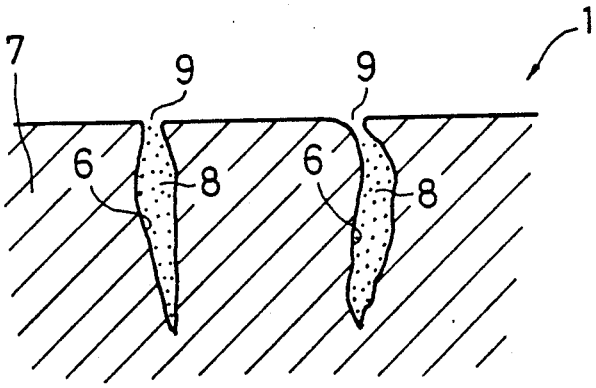
FIG. 3 is a view similar to FIG. 2, showing an alternative embodiment of the present invention to which sealing is applied.

Referring to FIG. 3, an alternative embodiment of the present invention is shown to which a sealing operation is applied. Specifically, in this particular embodiment, the evaporator 1 produced by the above-stated procedure is further immersed in a solution of nickel acetate or in pure water and then heated. This additional step causes the walls of the pores 6 to swell by cubical expansion, resulting in the pores 6 being sequentially stopped up. Such stopping sequentially proceeds from the open ends 9 toward the bottoms of the pores 6. It follows that by effecting the sealing step to an adequate degree, it is possible to restrict the open ends 9 of the pores 6, as shown in FIG. 3. The restricted open ends 9 is successful in further suppressing the outflow of the fungicide 8, while the fungicide 8 acting through such restricted openings 9 can be controlled in the intensity and continuity of the action.

The illustrative embodiments have been shown and described as applying the surface treatment to the entire surfaces of the evaporator assembly 1. Alternatively, the anodized surface layer 7 may be formed only on a limited part of the evaporator 1, e.g., on the fins 3 with the fungicide 8 being filled in the pores 6. This is comparable with the illustrative embodiments regarding the advantages. The present invention is, therefore, applicable even to an evaporator wherein only the fins 3 are made of aluminum or alloy thereof.

It will be needless to mention that the present invention is applicable not only to an evaporator for use in an automotive air conditioning system but also to other various evaporators made of aluminum and which is apt to collect water thereon, e.g. an evaporator incorporated in a refrigerator.

In summary, in accordance with the present invention, a heat exchanger made of aluminum has its surfaces anodized and retains fungicide in the resulting numerous pores. With such a structure, the heat exchanger allows the fungicide to be deposited on its surface easily and surely and is therefore prevented from gathering mold. Since the pores retain a great amount of fungicide thereinside, the anti-mold effect is guaranteed over a long period of time.

The action of the fungicide is controllable by adopting sealing, whereby efficient prevention of mold is realized. Further, the heat exchanger of the present invention eliminates the need for an expensive coating and a complicated mechanism for mold prevention and is, therefore, inexpensive. Of course, the anti-mold implementation of the present invention does not degrade the expected function of the heat exchanger at all.

Various modifications will become possible for those skilled in the art after receiving the teachings of the present disclosure without departing from the scope thereof.

What is claimed is:

1. A heat exchanger having fins and a tube at least one of which is made of aluminum or aluminum alloy, comprising:

an anodized surface layer having numerous pores therein and provided on at least a part of surfaces of said fins or said tube which is made of aluminum, said pores have open ends which are partially closed by sealing; and fungicide filled in said pores of said anodized surface layer.

* * * * *